US006186249B1

(12) United States Patent
Bjornstad

(10) Patent No.: US 6,186,249 B1
(45) Date of Patent: Feb. 13, 2001

(54) RELEASE EQUIPMENT FOR A DRILL STRING

(76) Inventor: Thor Bjornstad, Lande, N-4500, Mandal (NO)

( * ) Notice: Under 35 U.S.C. 154(b), the term of this patent shall be extended for 0 days.

(21) Appl. No.: 09/355,290

(22) PCT Filed: Jan. 14, 1998

(86) PCT No.: PCT/NO98/00012

§ 371 Date: Jul. 26, 1999

§ 102(e) Date: Jul. 26, 1999

(87) PCT Pub. No.: WO98/32946

PCT Pub. Date: Jul. 30, 1998

(51) Int. Cl.[7] ..... E21B 17/06
(52) U.S. Cl. ..... 175/320; 166/242.6
(58) Field of Search ..... 175/320, 323, 175/324, 325.1, 325.2, 325.3, 325.6; 166/242.6, 242.7, 238, 377, 382; 285/3, 358, 315

(56) References Cited

U.S. PATENT DOCUMENTS

| | | |
|---|---|---|
| 2,039,943 | 5/1936 | Wickersham et al. . |
| 2,708,100 | 5/1955 | Sutliff et al. . |
| 3,895,829 | 7/1975 | Manson, Jr. . |
| 5,146,984 | 9/1992 | Pleasants . |
| 5,787,982 | 8/1998 | Bakke . |

FOREIGN PATENT DOCUMENTS

| | | |
|---|---|---|
| 528 255 | 6/1931 | (DE) . |
| 0244 194 A2 | 11/1987 | (EP) . |

*Primary Examiner*—Robert E. Puzzuto
(74) *Attorney, Agent, or Firm*—Knobbe, Martens, Olson & Bear, LLP

(57) ABSTRACT

A release piece for a drill string is adapted to disengage upon activation in connection with a bit stuck in the lower portion of the bore hole during drilling. An elongated tubular release piece (10*a*, 10*b*) is, at the ends (12*a*, 12*b*) thereof, formed to be coupled into the drill string, upstream the bit. The drill string release piece comprises two substantially coaxial sleeve parts (10*a*, 10*b*) disposed in the continuation of each other and screwable together, the sleeve parts (10*a*, 10*b*) internally being provided with axially directed locking device (16*a*, 16*a'*, 16*b*, 16*b'*). An internal, axially displaceable locking device (18) has locking device (28', 28") capable of cooperating lockingly with the locking device (16*a*, 16*a'*, 16*b*, 16*b'*) of both sleeve parts (10*a*, 10*b*), the locking position being maintained by a spring (22). In a drill string release situation, the spring action is neutralized, the drill string, thereafter, being rotated in order to unscrew the two sleeve parts (10*a*, 10*b*) from each other, whereafter the drill string can be hauled up.

4 Claims, 3 Drawing Sheets

RELEASE EQUIPMENT FOR A DRILL STRING

BACKGROUND OF THE INVENTION

The present invention relates to a release equipment or accessory for a rotating drill string, said drill string release accessory being adapted for activation in order to release and disengage the drill string, e.g. upon a wedged bit situation or other situations where an accessory is stuck in a bottom hole position.

At high drilling speeds, e.g. 100 meters per hour, there exists a particularly great risk for the bit to get wedged and stuck in the formation in which drilling is carried out. There are examples where several thousand metres of drilled hole have been lost in connection with such wedged and unsuccessful drill string release situations. When such situations arise, it is important to have the drill string released as rapidly as possible and, thereafter, to return to ordinary drilling without having lost too much old bore hole.

If the bit wedges itself or get stuck in some other way in the formation in which drilling is carried out, one will, at first, try to pull the bit free in an upward direction, by means of the drill string. Often, this cannot be done and, therefore, in order to get the drill string released, explosives in the form of an explosive charge suspended from a wire are pumped down to the place where the bit is wedged, in order to free the stuck bit through blasting to pieces a drill string portion above the stuck bit.

Thus, conventional and other known technology comprises, first of all, the use of explosives and the utilization of blasting technique. Primarily, this is time-consuming because it takes time to mobilize accessories and personnel. Additionally, the blasting in itself represents a risk moment, namely upon unintentional blasting to pieces the surrounding formation and destructing old bore hole.

SUMMARY OF THE INVENTION

According to the present invention, one has aimed at providing a release device adapted to be coupled into a drill string in order to, using simple and cheap means as well as non-complex operational steps, enabling the release of the bit or other bottom hole equipment, respectively, avoiding the large time delays associated with the prior art.

In accordance with the invention, this is realized by means of a drill string release piece such shaped and designed that it exhibits the following features of a splined locking piece to be joined into a drill string to couple and uncouple a pair of locking sleeves by engaging mating splines in the locking sleeves. The splines of the locking piece are locking members comprising straight, axially extending grooves and intermediate, straight, axially extending, list-shaped projections that exert no wedging effect. The locking members of one sleeve part in the end portion thereof, extend from a radial contact face common for the two sleeve parts, axially away therefrom. The other sleeve part's locking members extend in the opposite direction, axially away therefrom. The locking members of the locking device are gathered in a toothed rim-like portion on the locking device. One sleeve part's straight, axially extending grooves are axially aligned with the other sleeve part's straight, axially extending grooves and also aligned with the locking device's straight, list-like projections, while said one sleeve part's straight, list-like locking members are axially aligned with the other sleeve part's straight axially extending projections, and the locking device's straight, axially extending grooves. One axial end of the tubular, locking device has a seat for a ball-shaped sealing body for closing the through-going bore, in order to establish sealing conditions to enable hydraulic exertion of force against ball and seat in order to cause an axially directed displacement of the locking device for the purpose of releasing the two sleeves.

Such a release piece is elongated and has a longitudinal symmetry axis. It comprises two at adjacent end portions interscrewable sleeve parts having coaxial, axially through-going bores and each, at the opposite end thereof, is shaped in order to be connected to an opposing end portion of an upstream drill string section and an end portion of a downstream drill string section extending down to the bit, respectively.

The elongate release piece may be positioned in the neighbourhood of the bit or other bottom hole equipment.

If right-hand threads have been chosen for adjacent, interscrewable drill pipe sections incorporated in a drill string, preferably left-hand threads are chosen for the threaded connection between the release piece's two screwable/unscrewable sleeve parts.

In the release piece is, as an essential component, included a locking device comprising locking means cooperating partly with locking means associated with one sleeve part, partly with locking means associated with the other sleeve part, a force-exerting means, preferably a spring, e.g. a pressure spring in the form of a screw spring, maintaining the locking device in the locking position and, thus, the cooperating locking means in mutual engagement until it intentionally is created a counter force which is larger than the holding force yielded by said pressure spring.

The locking device of the release piece may have the form of a separate, elongate, tubular element having an axially through-going bore. The locking means thereof may consist of an axially directed roller having a gear wheel-like cross-sectional shape, exhibiting parallel, longitudinally extending grooves equidistantly distributed circumferentially and intermediate, list-shaped projections (teeth). In principle, the locking device of the release piece comprises at least one longitudinal projection and/or at least one longitudinal groove.

Then, the locking device's at least one longitudinal projection/groove will cooperate with one locking means in the form of a longitudinal groove/projection assigned each of the sleeve parts, but it is preferred that the locking device as well as each of the sleeve parts have several parallel locking means in the form of longitudinal grooves and therein engaging, substantially complementary projections, preferably equidistantly distributed around the circumference of the locking body of the locking device and with locking means disposed along the internal circumference of cavities in the screwing area, for said locking body.

One of these cavities has a radially directed stop face against which one end of said spring rests supportingly.

The tubular locking element/device is axially displaceably mounted in the aligned bores in the sleeve parts, the locking means of the locking body are being kept in engagement with corresponding locking means internally assigned the sleeve parts which are screwed together, said spring acting as a force-exerting safety means which secures the mutual engagement of the locking means and, thus, the the locking action.

In a drill string having a release device of the invention mounted therein, positioned just above the bit, and where the drill string is rotary, the upstream portion (above the bit) of the drill string may rapidly and simply be released from the stuck bit through the release device according to the invention, in the following way:

One end of the tubular locking device, i.e. the upper end in the position of use, is, preferably, formed with a circumferential, upwardly facing seat for a ball-shaped body having a somewhat larger circumference than that of the seat, or a similarly shaped and dimensioned closure means, e.g. a plug, which can be dropped from a surface position.

After said ball has landed in the upper seat of the tubular locking device, the pump pressure—representing a counter force acting against the spring—is increased to exceed the spring force. Thus, the spring is compressed, allowing displacement of the locking device. Upon this displacement of the tubular locking device in the downstream direction, the locking engagement between locking means assigned to the upstream sleeve part and locking means assigned to the locking device is neutralized. The axial length of engagement between these locking means is originally, preferably, somewhat less than the axial degree of compression of the spring. The pressure spring can be biased such that e.g. 200 bar excess pressure must be utilized before said locking means become disengaged.

Subsequent to the situation when the two sleeve parts are no longer locked to each other, the drill string is rotated such that the adjacent, threaded end portions on the sleeve parts are unscrewed from each other, whereafter the lower sleeve part becomes connected to the stuck bit and possible other down hole asseccory only, while the upper sleeve part becomes connected to the upstream drill string only and will be hauled up therewith.

BRIEF DESCRIPTION OF THE DRAWINGS

A non-restricting example of a preferred embodiment is further explained in the following, reference being made to accompanying drawings, in which.

DETAILED DESCRIPTION OF THE INVENTION

Figure 1:
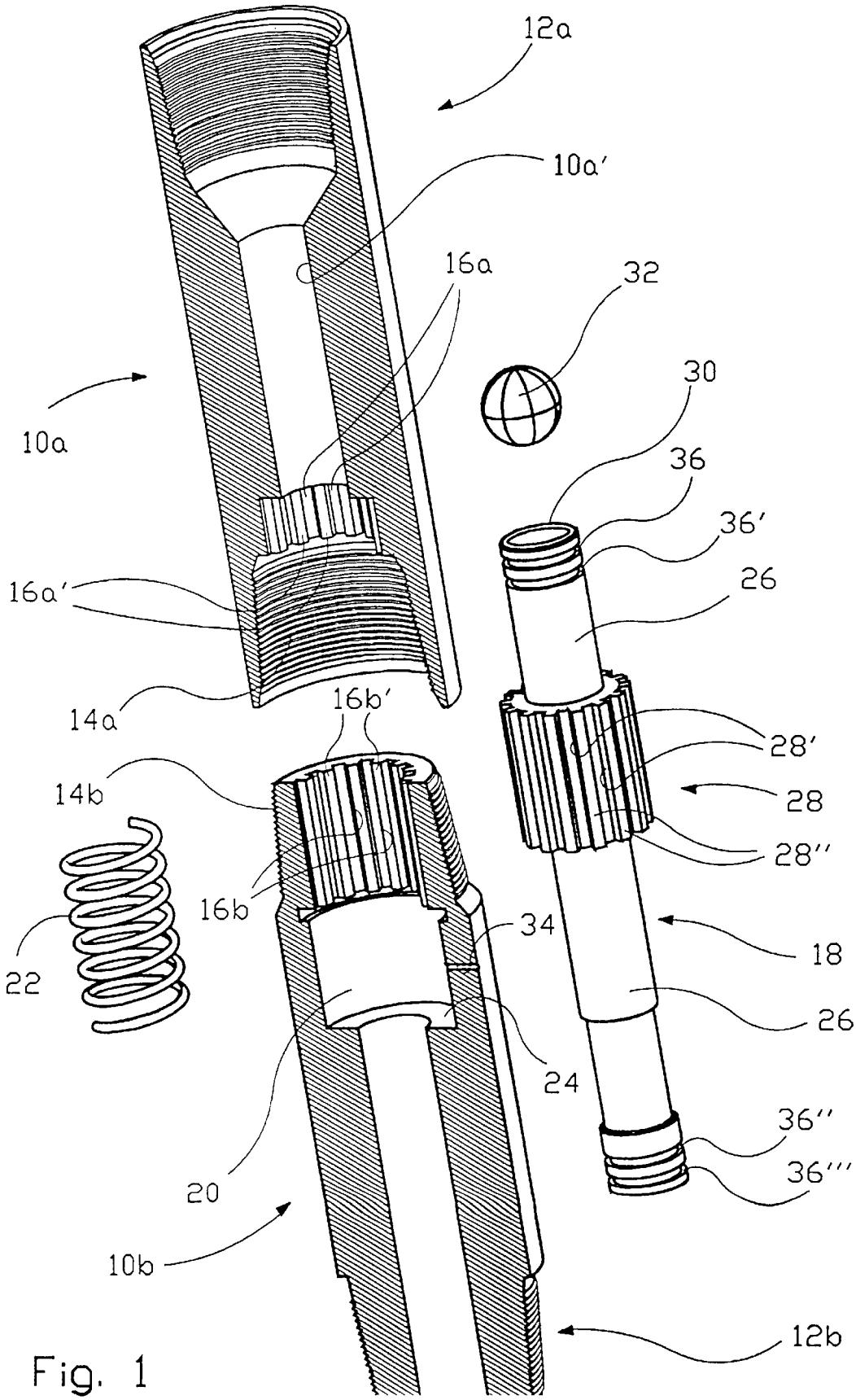
FIG. 1 shows an exploded view of four parts included in the release device as well as a ball-shaped body used in order to close the axially through-going bore through the release device.

First, reference is made to FIG. 1, in which reference numerals 10*a* and 10*b* denote two sleeve parts adapted to be screwed together. Upon vertically or approximately vertically drilling, the sleeve part 10*a* constitutes the upstream sleeve part and the sleeve part 10*b* the downstream sleeve part, referred to a downhole bit or another bottom hole accessory (not shown) at the end of a drill string (not shown), into which the shown release piece 10*a*, 10*b* is coaxially inserted. For the connection to the drill string, each sleeve part 10*a* and 10*b*, respectively, has a threaded end portion in the form of an internally threaded end portion 12*a* on the upstream sleeve part 10*a* and an externally threaded end portion 12*b* on the downstream sleeve part 10*b*, respectively.

The upstream sleeve part 10*a* has an internal, axially inwardly tapering, conical, threaded socket portion 14*a* adapted to be screwed together with an external, axially outwardly tapering, conical, threaded pin portion 14*b* formed on the end portion of the downstream sleeve part 10*b*, which internally thereof is formed with a cylindrical bore formed with longitudinal, parallel grooves 16*b* and intermediate, list-shaped projections 16*b*' directed radially inwardly, the projections 16*b*' in the examplary embodiment being distributed equidistantly in the circumferential direction of said cylindrical bore. These alternating projections 16*b*' and grooves 16*b* constitute locking means to be further described later in connection with corresponding locking means formed in the other sleeve part 10*a* and on a special locking device generally denoted at reference numeral 18.

Axially inwardly of the internal cylindrical portion in which the locking means 16*b*, 16*b*' are formed, a spring room 20 has been formed in the downstream sleeve part 10*b*, accommodating a pressure spring in the form of a screw spring 22 or another force-exerting means, e.g. a rubber-elastical means, said spring room 20 being defined by a radial stop face 24, against which one end of the pressure spring 22 rests supportingly in the position of use thereof.

Axially inwardly of its threaded end portion 14*a*, the upstream sleeve part 10*a* has an internal cylindrical portion having locking means 16*a*, 16*a*' similar to those of the downstream sleeve part 10*b*.

In the present examplary embodiment, the groove-shaped locking means 16*a* and 16*b* of the sleeve parts 10*a* and 10*b* are aligned with each other in the axial direction of screwed-together sleeve 10*a*, 10*b*.

Figure 2:
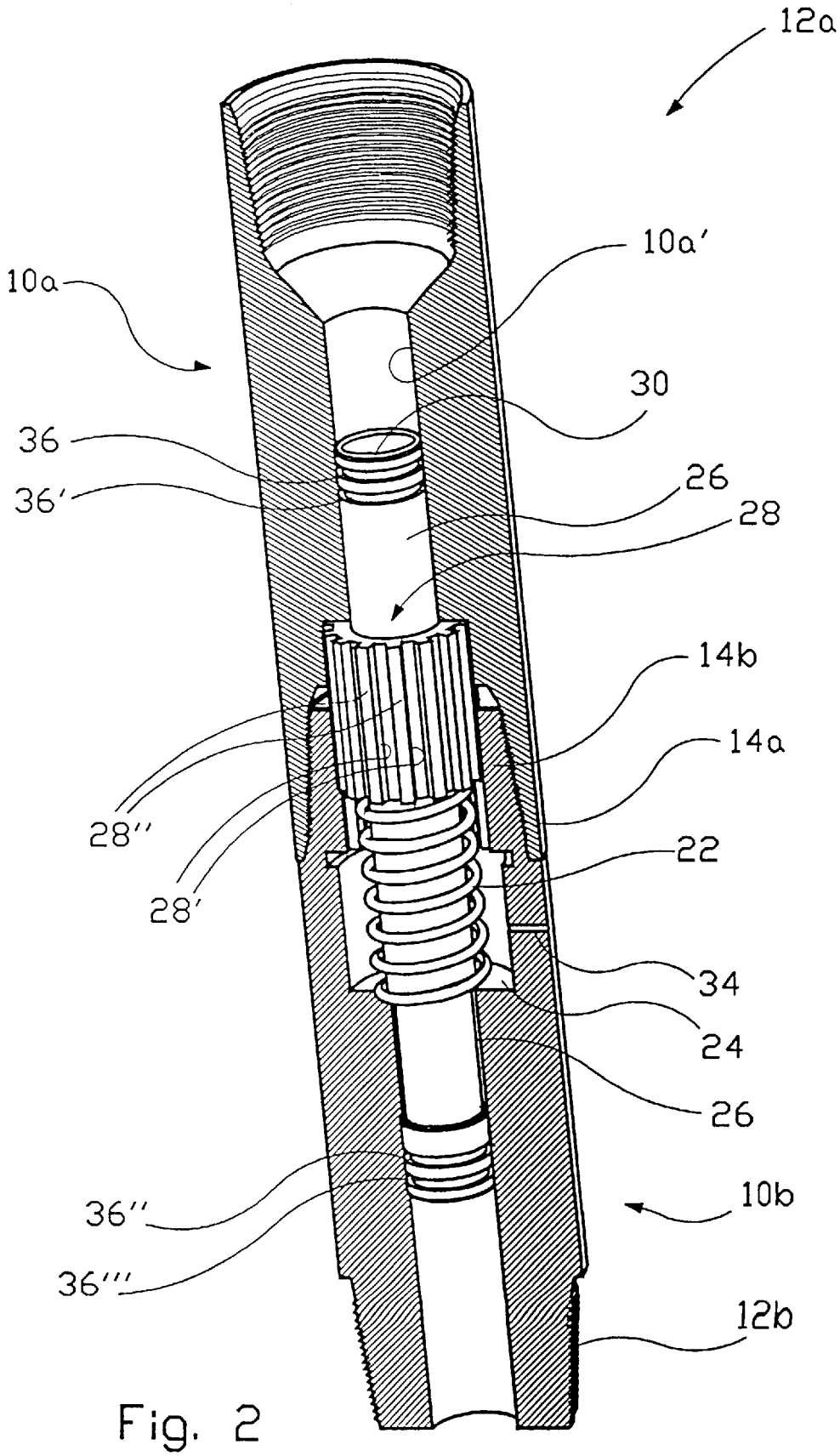
FIG. 2 shows the release device, parts seen in an assembled, locked, secured position, partially in axial section, partially in side elevational view.

Said locking device 18 is constituted by an elongate tubular body 26 having a through-going bore and a fixed locking body 28 having a gear-wheel-like cross section, formed complementarily to the locking portions 16*a*, 16*a*' and 16*b*, 16*b*' internally within the sleeve parts 10*a*, 10*b*. In the shown examplary embodiment, the longitudinal, parallel grooves 28' in the locking body 28 of the locking device 18 extend axially aligned with the locking projections 16*a*', 16*b*' of the sleeve parts 10*a*, 10*b*, while the longitudinal, list-shaped projections 28" positioned intermediate the grooves 28' extend in alignment with the parallel, mutually aligned grooves 16*a*, 16*b* of the sleeve parts 10*a*, 10*b*. Upon the assemblage of the sleeve parts 10*a*, 10*b* and the locking device 18, said grooves and projections are brought into engagement with each other, so that the elongated, longitudinal projections 28" of the locking device 18 mesh displaceably into the internal, elongated, longitudinal grooves 16*a*, 16*b* of the sleeve parts. The spring 22 maintains this locking engagement of the locking means 16*a*, 16*b*, 28", 16*a*', 16*b*', 28' when it occupies the inserted operative position, FIG. 2.

It appears immediately that the locking means 16*a*, 16*b*, 28", 16*a*', 16*b*', 28' prevent a rotation of the sleeve parts 10*a* and 10*b* in relation to each other, so that their screwing-together at 14*a*, 14*b* can not be nullified as long as the spring 22 is not compressed axially.

Advantageously, the upstream end of the elongated, tubular part 26 of the locking device 18 may be formed with a seat 30 for a ball-shaped body 32 having a somewhat larger diameter than the largest internal diameter of the seat 30.

Figure 3:
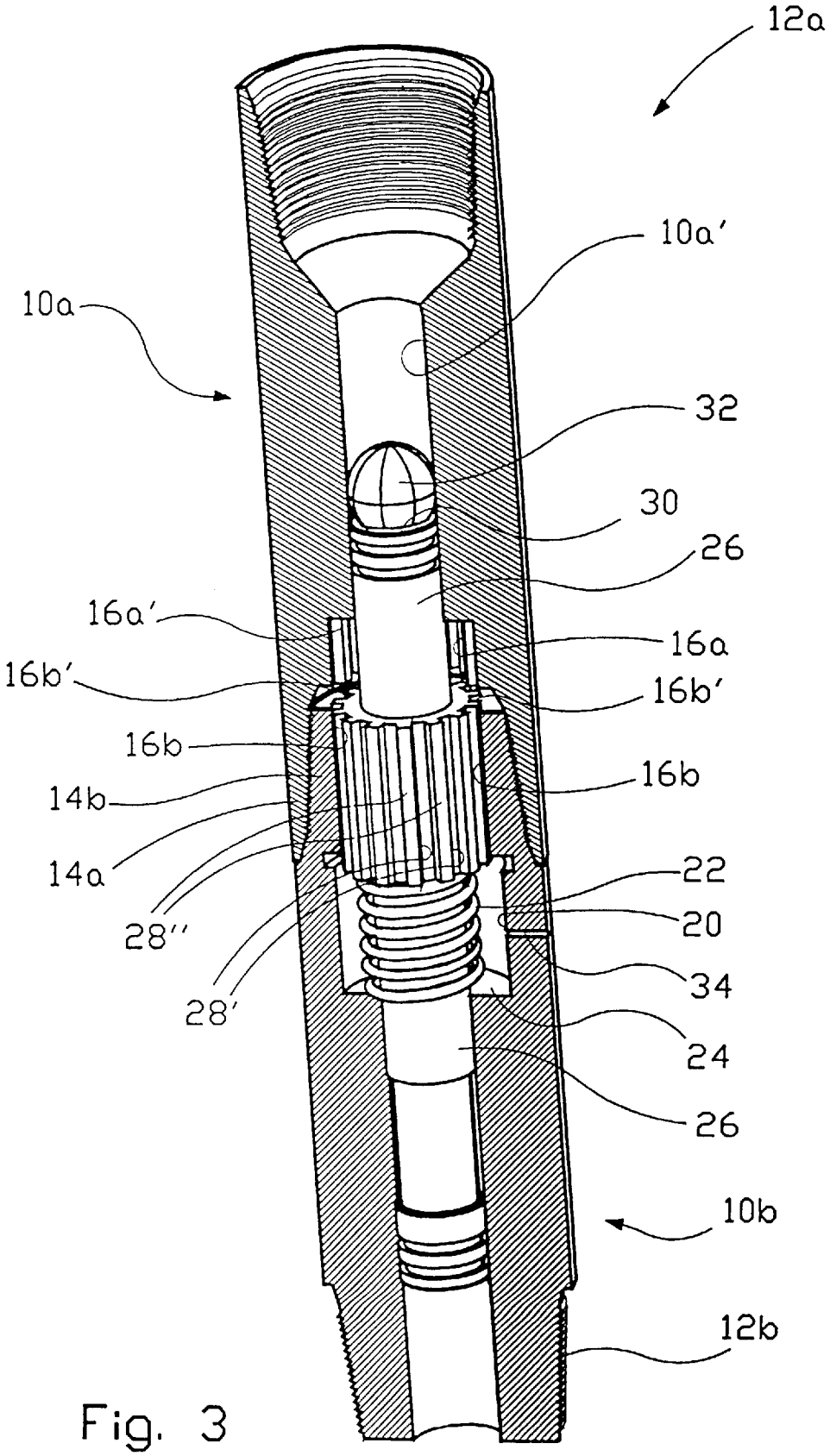
FIG. 3 corresponds to FIG. 2, but here the locking is nullified, previously cooperating, mutually engaging locking means (in upper sleeve part and on locking device) being pushed out of engagement, the upper sleeve part's locking means being disengaged.

If a bit, not shown, connected below the downstream sleeve part 10*b*, preferably through an intermediate drill string portion (not shown), wedges itself and get stuck in the formation, the release device 10*a*,10*b* is activated through the drop of the ball-shaped body 32 down through the drill string (not shown), guided by the bore 10*a*' of the upstream sleeve part 10*a* to rest sealingly against the seat 30, FIG. 3. Thus, the axial passage through the release piece 10*a*,10*b* is closed, and the ball's 32 upper half forms a reaction face for an increased pump pressure which is caused to increase until it exceeds the spring force. Then, the spring 22 is compressed and allows longitudinal displacement movements of locking means 16*a*, 16*a*', 16*b*, 16*b*', 28', 28", until the locking device's 18 locking means 28', 28" have been pulled out of their engagement with the locking means 16*a*, 16*a*' of the upstream sleeve part 10*a*, resulting in a neutralization of the rotation-preventing engagement between certain locking means. When, thereafter, the drill string (not shown), which is connected to the release piece 10*a*,10*b*,18 through the upstream sleeve part 10*a*, is rotated from a surface position, the sleeve parts 10*a*, 10*b* are unscrewed from each other, and the drill string can be hauled up.

Into the spring room 20 extends a narrow oil filling gate 34. Through this gate, one may pressure-test whether or not the release piece is sealed and tight, i.e. in order to control that packers (not shown) are in order. Reference numerals 36, 36', 36" and 36'" denote grooves formed in the locking device 18 and serving to accommodate seals (O-rings). The room 20 may be filled with oil in order to preserve both the spring 22 and locking means. The oil filling gate 34 may be provided with threads so that it may be closed by means of a screw, not shown.

What is claimed is:

1. A release piece to be joined coaxially into a drill string having a bore, and adapted to be activated in connection when the drill string has a stuck bit, comprising:

two substantially coaxial sleeve parts adapted to be screwed together at adjacent end portions and which are internally equipped with longitudinal tooth-intertooth space-like locking members, the sleeve parts having a through-going bore in which is disposed an axially displaceable, sleeve-like locking device having cooperating, complementary locking members which, in a first, locking position the locking device is pressed by a coaxial, helical spring to place the locking members of the locking device into engagement with the locking members of both sleeve parts in order to secure the mutual interconnection of the sleeve parts to maintaining them screwed firmly together, and which, in a second, release position of the locking device, the locking members of the locking device only engage the locking members of one sleeve part thus neutralizing the locking of the other sleeve part so that the other screw part can be unscrewed and removed from said one sleeve part leaving the locking device in engagement with the one sleeve part only, and wherein all locking members consist of straight, axially extending grooves and intermediate, straight, axially extending, list-shaped projections exerting no wedging function when in engagement with each other, and wherein the locking members of one sleeve part in the end portion thereof, extend from a radial contact face common for the two sleeve parts, axially away therefrom, from where the other sleeve part's locking members extend in the opposite direction, axially away therefrom, and wherein one sleeve part's straight, axially extending grooves are axially aligned with the other sleeve part's straight, axially extending grooves and also aligned with the locking device's straight, list-like projections, while said one sleeve part's straight, list-like locking members are axially aligned with the other sleeve part's straight axially extending projections, and the locking device's straight, axially extending grooves, and wherein a loose ball-shaped sealing body is used in order to close the through-going bore of the pipe string in the area of the locking device to enable a subsequent displacement of the locking device toward the second, release position by exerting a hydraulically force on said ball-shaped sealing body, and wherein the sleeve-like locking device further comprises a toothed rim-like portion on a coaxial, elongate, axially displaceable, tubular spindle that is spaced from both ends portions of the spindle, said end portions being dimensioned for rectilinear guidance in the bore of the drill string during the longitudinal displacement of the locking device when the locking device is being moved from one of its end positions to the other and vice versa, one axial end of said tubular spindle having a free seat for sealingly receiving said ball-shaped sealing body, and wherein the locking device in the form of a toothed rim-like portion on the substantially more elongated, tubular spindle is formed as a concentrically, thickened portion thereon, exhibiting opposite, annular, radially extending faces, of which one forms a stop face for one end of the helical spring, with an opposing end of the spring resting supportingly against an internal, radial stop face of the sleeve part, restricting a spring room in one axial direction thereof, the helical spring being housed and guided within said spring room, the spring surrounding a portion of said elongated, tubular spindle.

2. A release piece as defined in claim 1, wherein a wall of the other sleeve part surrounding said spring room is provided with a lateral, through-going substantially radially directed oil filling gate enabling pressure tests to be carried out through the intermediary of said spring room, in order to ascertain whether the release piece is sealed and tight.

3. A release piece for releasably joining first and second coaxial sleeve parts of a drill string and disconnecting the drill string when a drill bit becomes stuck, the second sleeve being closer to the bit than the first sleeve during use, each of the sleeves having correspondingly configured engaging parts so the sleeves can be releasably fastened together by rotating the sleeves relative to each other, each of the sleeves having an internal bore on which are formed a plurality of axially aligned splines extending inward toward a longitudinal axis of the drill string; comprising:

a locking device placed in the bore of the two sleeves, the locking device having a through-going bore, the locking device having a plurality of axially aligned splines formed on an enlarged portion that is located intermediate smaller diameter first and second ends with the ends sized and configured so they extend into the bore of the sleeves in opposing directions from the enlarged portion, the locking device being movable between a locking position and a release position, the splines of the locking device mating with the splines of both sleeves in the locking position and mating with the splines of only the second sleeve in the release position, the locking device having a seat formed on the first sleeve, the seat being configured to receive a ball and form a fluid tight seal blocking flow through the through-going bore of the locking device so that the force on the ball can move the locking device from the locking position to the release position;

a helical spring coaxial with and encircling the second end of the locking device, which second end is closer to the bit than the first end, the spring having one end resiliently urged against a portion of the second sleeve and an opposing end resiliently urged against the enlarged portion to urge the locking device into the engaged position, the spring being located in a cavity defined within the second sleeve, and a gate formed in the second sleeve providing access to the cavity from outside the second sleeve.

4. A release piece as defined in claim 3, wherein the first and second ends of the release piece each have grooves containing O-rings to seal against the bore of the first and second sleeves, respectively.

* * * * *